United States Patent [19]

Yoshikawa et al.

[11] 4,378,513

[45] Mar. 29, 1983

[54] HIGH PRESSURE DISCHARGE LAMP APPARATUS

[75] Inventors: Nobuhisa Yoshikawa, Sakai; Shigeru Horii, Suita; Kazutaka Koyama, Nishinomiya, all of Japan

[73] Assignee: Matsushita Electric Industrial Co., Ltd., Kadoma, Japan

[21] Appl. No.: 268,116

[22] Filed: May 28, 1981

[30] Foreign Application Priority Data

Jun. 12, 1980 [JP] Japan ..... 55-79774

[51] Int. Cl.[3] ..... H05B 37/00

[52] U.S. Cl. ..... 315/176; 315/174; 315/207; 315/DIG. 7

[58] Field of Search ..... 315/226, DIG. 5, DIG. 7, 315/160, 207, 174, 176, DIG. 2

[56] References Cited

U.S. PATENT DOCUMENTS

| | | | |
|---|---|---|---|
| 2,629,071 | 2/1953 | Anderson | 315/176 |
| 3,066,243 | 11/1962 | Mutschler | 315/176 |
| 3,259,797 | 7/1966 | Heine et al. | 315/174 |
| 3,309,567 | 3/1967 | Flieder et al. | 315/176 |
| 3,876,855 | 4/1975 | Hirasawa | 315/171 |
| 3,944,876 | 3/1976 | Helmuth | 315/205 |
| 4,323,824 | 4/1982 | Roche et al. | 315/DIG. 2 |

*Primary Examiner*—Harold A. Dixon

*Attorney, Agent, or Firm*—Cushman, Darby & Cushman

[57] ABSTRACT

A high pressure discharge lamp apparatus comprises:

a discharge tube and a current limiting device such as a choke coil connected in series for connection across an A.C. power source, and a pulse generator connected by its output terminal in parallel to the discharge tube, the apparatus is characterized in that:

said pulse generator impresses reignition pulses on said discharge tube at least during a period defined as from a zero-cross point of the source voltage of the power source to a phase defined by a peak of reignition voltage of lamp voltage waveform when no reignition pulse is impressed on the discharge tube, thereby retaining lamp current of the discharge tube without forming zero-current period, thereby the lamp is stably lit with such a high lamp voltage as is almost equal to the power source voltage and the power of reignition pulse can be saved without harming stability of lighting. Thus a stable lighting of the high pressure discharge lamp with a a high power efficiency becomes possible.

4 Claims, 6 Drawing Figures

HIGH PRESSURE DISCHARGE LAMP APPARATUS

BACKGROUND OF THE INVENTION

1. Field of the Invention

This invention relates to an improvement in a high pressure discharge lamp apparatus such as a high pressure mercury lamp apparatus, a high pressure sodium lamp apparatus, or a high pressure metal-halide lamp apparatus. The present invention especially concerns an improvement in a high pressure discharge lamp apparatus of the type comprising a high pressure discharge tube, a current limiting device, for instance a choke coil and a pulse generator for impressing pulses across the discharge tube for lighting the tube with a lamp voltage nearly equal to a power source voltage.

2. Description of the Prior Art

Generally, in a conventional high pressure discharge lamp apparatus, a current limiting device such as a choke coil and a discharge tube are connected in series across a power source.

In the abovementioned type of the high pressure discharge lamp apparatus, a voltage of the power source should be maintained over 1.5 times a voltage of the discharge tube for preventing an extinction of ignition in the tube.

In order to improve the abovementioned shortcoming, an improvement has been devised such that the discharge lamp is ignited each cycle by a circuit, for example, of FIG. 1. The conventional apparatus of FIG. 1 comprises a specially designed current limiting device 2' having an additional coil 202, besides the ordinary choke coil 201 which is connected in series to the discharge tube 3 across the power source 1. A capacitor 203 and a voltage-responsive switching device 5 are connected in series to said additional coil and the series connection of these is connected across both terminals of the discharge tube 3. The additional coil 202 and the capacitor 203 form a resonance circuit 204. In this circuit, pulse current is produced in the series circuit of the resonance circuit 204 and the switching device 5 during the while lamp current is not flowing, and therefore, high voltage pulses are impressed across the discharge tube by means of the choke coil 201. In such reignition circuit of self-excitation type the lamp current has a zero-current period in each cycle, and therefore, the apparatus has the shortcomings that:

(i) The input current has distorted waveform having a considerable components of third and fifth higher harmonic waves, thereby the apparatus becomes a noise source, (ii) Apart from the fluorescent lamp where such self-excitation type reignition is effective and extinctions rarely occur, in case of operating a high pressure discharge lamp a use of such self-excitation type reignition is liable to distinction since the existence of zero-current period causes an increase of reignition voltage.

Therefore the self-excitation type reignition is not suitable for the high pressure discharge lamp apparatus.

SUMMARY OF THE INVENTION

The present invention is to provide an improved high pressure discharge lamp apparatus capable of retaining stable lighting of the discharge tube with a power source voltage which is almost equivalent to that of the lamp voltage.

The apparatus of the present invention performs the abovementioned stable lighting by applying pulses produced by a separate excitation type reignition pulse generator to said discharge tube in each-half cycle of the voltage at least during the period defined as from a zero-cross of the source voltage to a phase of a peak of lamp voltage, so that no zero current period is made and hence the input current is not substantially distorted.

DESCRIPTION OF THE PREFERRED EMBODIMENT

A high pressure discharge lamp apparatus in accordance with the present invention is elucidated in detail now referring to the examples embodying the present invention with reference to the accompanying drawings.

Figure 1:
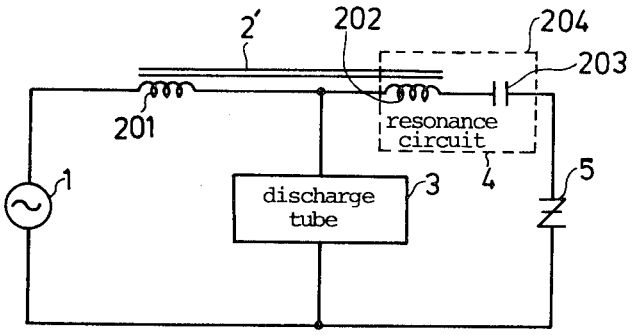
FIG.1 (Prior Art)
FIG. 1 is a circuit diagram of an example of a conventional high pressure discharge lamp apparatus.
Figure 2:
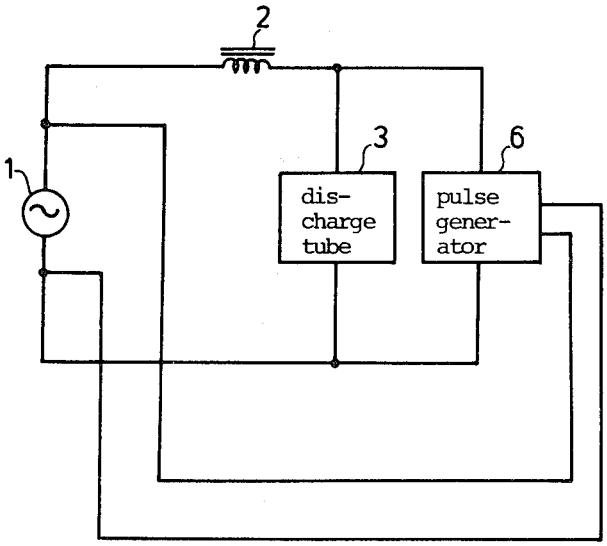
FIG. 2 is a block diagram showing a fundamental circuit constitution of the high pressure discharge lamp apparatus in accordance with the present invention.

As shown in FIG. 2, which shows the fundamental constitution of a high pressure discharge lamp apparatus in accordance with the present invention, the apparatus comprises:

a discharge tube 3 and a current limiting device 2 such as a choke coil connected in series for connection across an A.C. power source 1, and a pulse generator 6 connected by its output terminal in parallel to the discharge tube 3, and the apparatus is characterized in that:

said pulse generator 6 impresses reignition pulses on said discharge tube 3 at least during a period defined as from a zero-cross of the source voltage of the power source to a phase defined by a peak of reignition voltage of lamp voltage waveform when no reignition pulse is impressed on the discharge tube 3, thereby retaining lamp current of the discharge tube 3 without forming zero-current period.

The gist of the present invention lies in the period in which the pulse generator 6 impresses the reignition pulses across the discharge tube 3.

Figure 3:
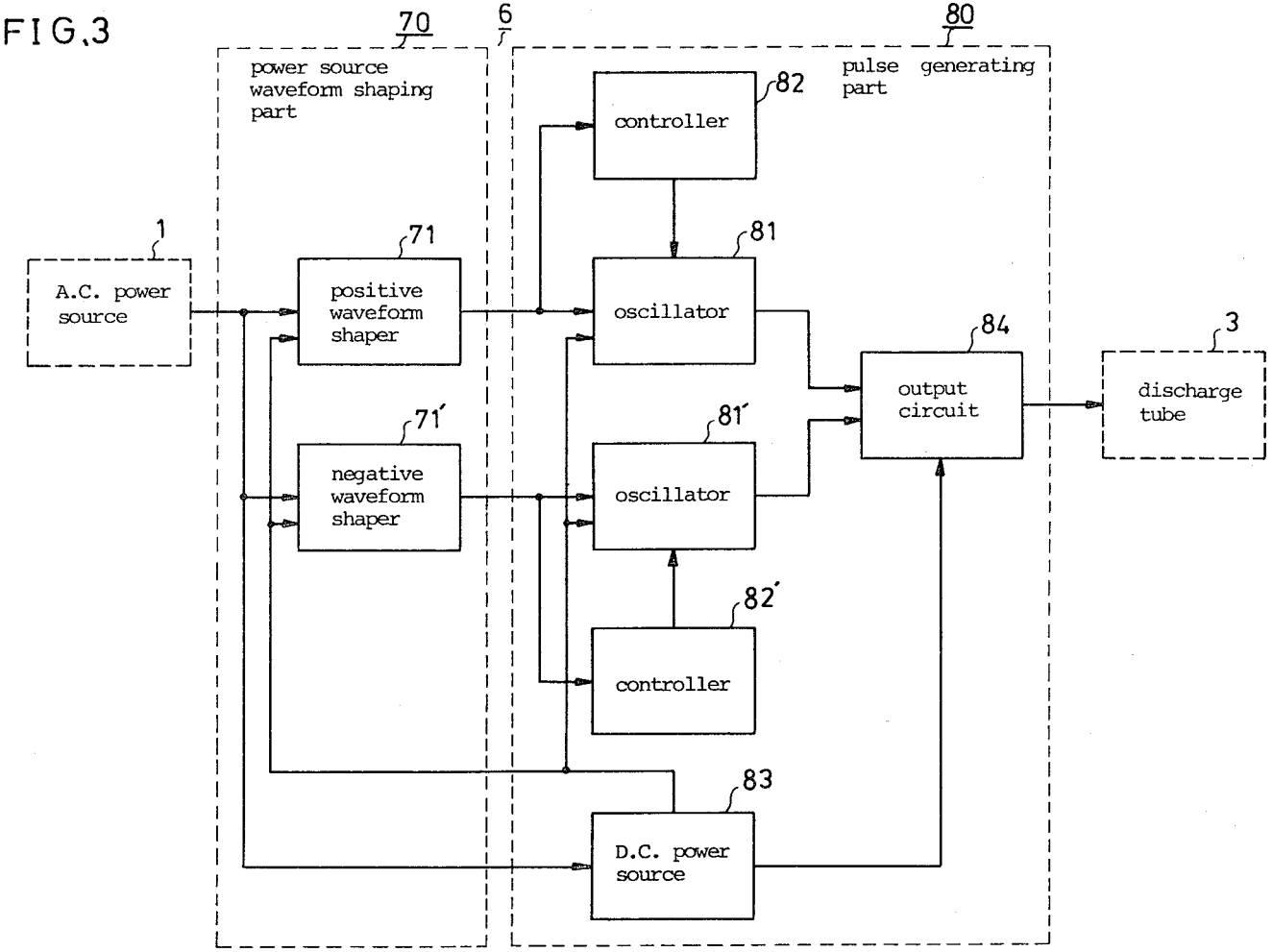
FIG. 3 is a block diagram showing detailed constitution of a pulse generator 6 in the high pressure discharge lamp apparatus in accordance with the present invention.

FIG. 3 shows an example of the pulse generator 6. The pulse generator of the example of FIG. 3 comprises a power source waveform shaping part 70 and a pulse generating part 80. The pulse generator 70 comprises a positive waveform shaper 71 which produces square waves from the positive parts of the A.C. power source voltage 1 and, a negative waveform shaper 71' which produces square waves from the negative parts of the A.C. power source voltage 1. The pulse generating parts 80 comprises oscillators 81 and 81' which are connected to receive output signals from the positive waveform shaper 71 and the negative waveform shaper 71', respectively, controllers 82 and 82' for controlling the oscillators 81 and 81', respectively, and output circuit 84 for amplifying the outputs of the oscillators 81 and 81' and outputting the composed output pulse.

Figure 4:
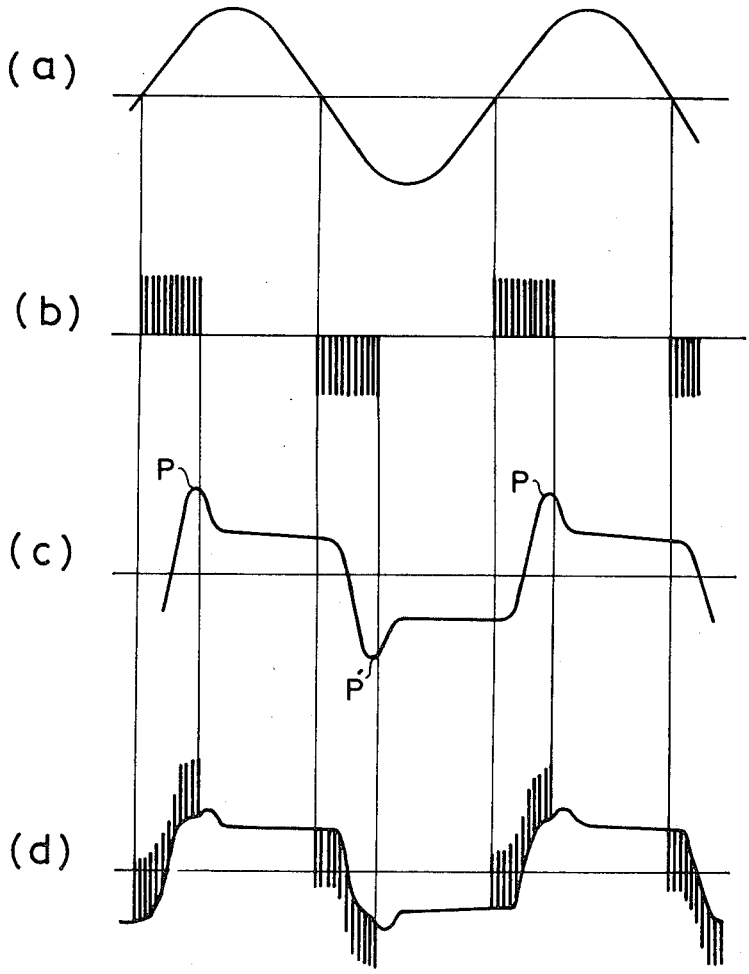
FIG. 4 is a waveform diagram showing waveforms of various parts of the apparatus in accordance with the present invention.

The operation of the pulse generator 6 of FIG. 3 is as follows:

Positive parts and the negative parts of the sinusoidal wave voltage signal of the power source 1 shown by FIG. 4(*a*) is clipped by means of the positive waveform shaper 71 and the negative waveform shaper 71', respectively, and thereby, positive and negative square wave pulses synchronized to the A.C. power source voltage are produced. The square wave pulses from the waveform shapers 71 and 71' are fed to the oscillators 81 and 81' to start oscillation therein. The square wave pulses form the waveform shapers 71 and 71' are also fed to the controllers 82 and 82', so that, the controllers 82 and 82' control the oscillators 81 and 81' to stop their oscillation in a manner that the oscillations of the oscillators 81 and 82' stop at predetermined phases of the A.C. power source voltage signal. Therefore output circuit 84 amplifies and issues reignition pulses of the waveform shown by FIG. 4(*b*). The lamp voltage waveform when the reignition pulse is not impressed thereon is as shown by FIG. 4(*c*), where the waveform has a peak of reignition voltage in each of positive half and negative half of a cycle. It is the important feature of the present invention that the reignition pulses shown by FIG. 4(*b*) should be impressed on the discharge tube at least in a duration from a zero-cross point of each half cycle to a phase defined by subsequent peak or immediately thereafter of reignition voltage of such lamp voltage waveform that which is when no reignition pulses are impressed. The waveform of actual operated lamp voltage when the reignition pulses are impressed becomes as shown by FIG. 4(*d*).

Figure 5:
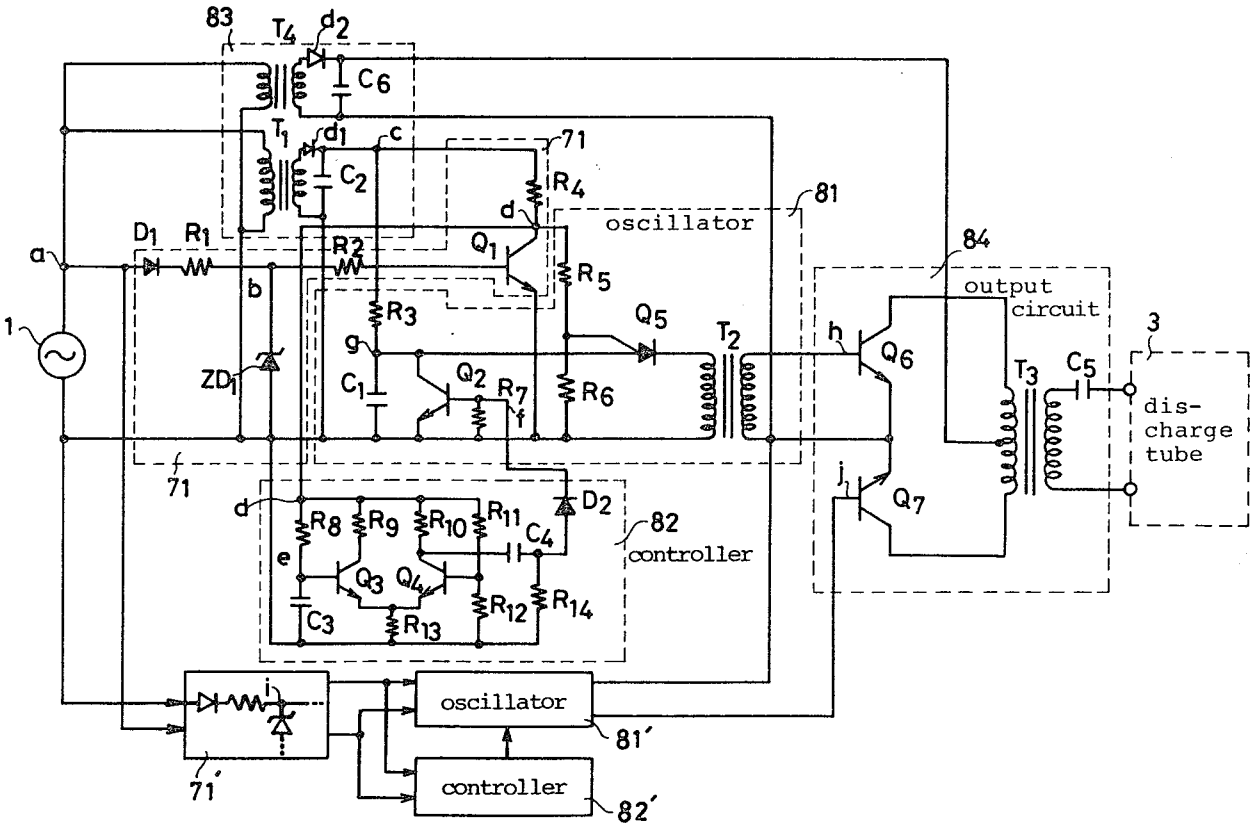
FIG. 5 is a circuit diagram showing one example of detailed circuit constitution embodying the present invention.
Figure 6:
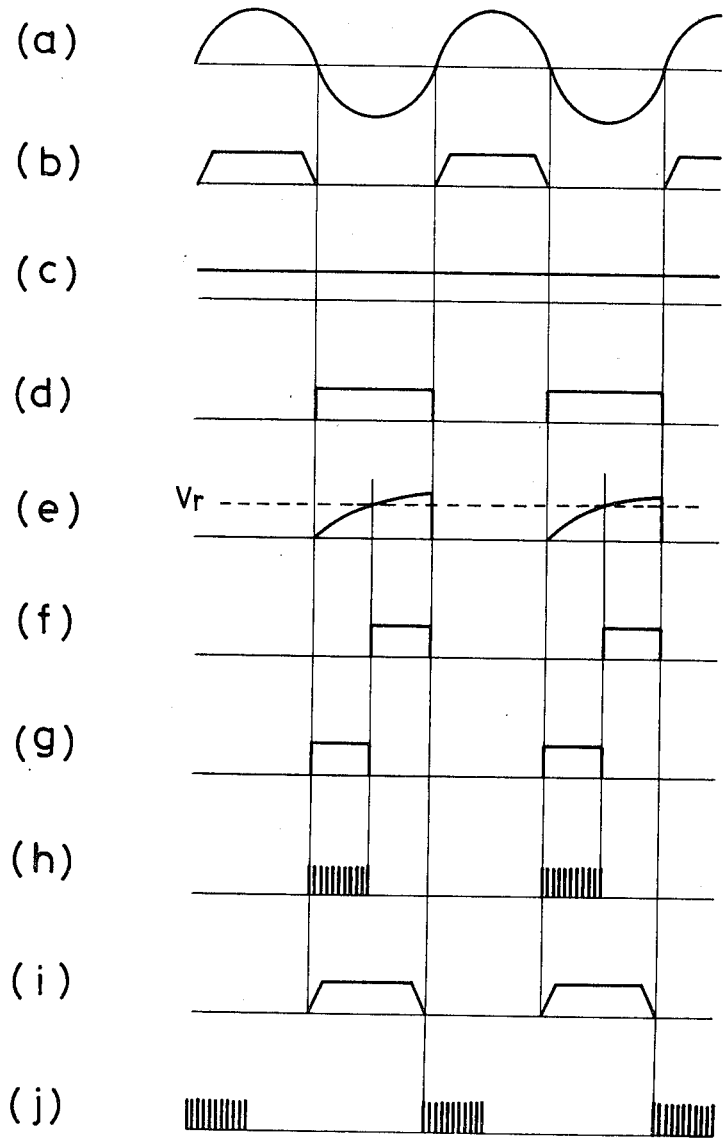
FIG. 6 is a waveform diagram showing waveforms of various parts of the circuit of FIG. 5.

FIG. 5 is a circuit diagram of an actual example of the circuit of FIG. 3. FIG. 6 is a timing chart showing waveforms of various parts of FIG. 5. The waveforms (a), (b), (c), (d), (e), (f), (g), (h) and (i) are those at the parts designated by the same marks.

The operation of the circuit is elucidated in detail for the operation of a positive half cycle of the A.C. power source voltage.

The sinusoidal wave voltage of FIG. 6(*a*) is impressed to the positive waveform shaper 71, wherein the voltage is rectified by a diode $D_1$ and is clipped by a constant voltage diode $ZD_1$ thereby forming a positive pulse wave shown by FIG. 6(*b*). A D.C. low voltage shown by FIG. 6(*c*) is supplied at the point c of the D.C. power source 83 after stepping down by a transformer $T_1$, rectified by a diode $d_1$ and smoothed by a capacitor $C_2$. Since the pulse signal of FIG. 6(*b*) is impressed on the base of the transistor $Q_1$, the transistor quickly turns on at each rise-up of the waveform of FIG. 6(*b*) and therefore a square wave of FIG. 6(*d*) which rises up at each zero-cross of the A.C. power source voltage is issued at the collector (d) of the transistor $Q_1$. This square wave is given to the controller 82. In the controller 82, the square wave of the waveform (d) is integrated by an integration circuit constituted by a resistor $R_8$ and a capacitor $C_3$ producing an integrated waveform of FIG. 6(*e*), which is given to the base of a transistor $Q_3$ of a voltage comparator $Q_3$–$Q_4$. In this voltage comparator $Q_3$–$Q_4$ the integrated wave of FIG. 6(*e*) is compared with a reference voltage defined by a voltage-divider $R_{11}$–$R_{12}$, so that, in each cycle of the A.C. power source voltage, at the time when the integrated voltage exceeds the reference voltage the comparator $Q_3$–$Q_4$ issues output signal, through a capacitor $C_4$ for cutting off D.C. component and a diode $D_2$, to the base of a shortcircuiting transistor $Q_2$ in the oscillator 81. The oscillator 81 comprising a PUT $Q_5$ as active element is fed with the voltage of the waveform (d) through a voltage-divider $R_5$–$R_6$, and when the shortcircuiting transistor $Q_2$ is in off state the oscillator 81 oscillates, thereby issuing reignition pulses as shown by FIG. 6(*h*). Since the voltage of the waveform (d) which rises up at the zero-cross points is fed to the PUT, the oscillation starts at each zero-cross point. And since the shortcircuiting transistor $Q_2$ receives square pulse signal of FIG. 6(*f*) at a predetermined time phase determined by the reference voltage $V_r$ which is defined by resistances of the resistors $R_{11}$ and $R_{12}$, the reignition pulses of FIG. 6(*h*) stops at a predetermined phase of each cycle. As already elucidated, the phase to stop the oscillation is selected at least after the phase defined by a peak of reignition voltage of the lamp voltage waveform when no reignition pulse is impressed on the discharge tube 3. The resistances of the resistors $R_5$ and $R_6$ are selected suitably for obtaining stable oscillation by the PUT $Q_5$. When both ends of the capacitor $C_1$ of the PUT oscillator is shortcircuited by the transistor $Q_2$, then the anode voltage of the PUT becomes zero, and hence the PUT stops its oscillation as elucidated above.

The oscillation output of the PUT is impressed through a coupling transformer $T_2$ on the input terminal (the bases) of a transistor $Q_6$ of the output circuit 84, and output of the circuit 84 is impressed on the discharge tube 3 through a coupling transformer $T_3$ and a coupling capacitor $C_5$.

Next, the operation of the circuit is elucidated for the operation of a negative half cycle of the A.C. power source voltage. For the negative half cycle operation, the negative waveform shaper 71', reignition pulse oscillator 81', and controller 82' for the negative half cycles are provided with the similar configuration to their counterparts 71, 81 and 82 for the positive half cycles. Differences to the parts for the positive half cycles are that connections to the A.C. power source 1 are made inversed. Thus, the voltage at the point i in the negative waveform shaper 71' has the waveform of FIG. 6(*i*), and accordingly, the reignition pulse output from the oscillator 81' to an input terminal j (the base) of a transistor $Q_7$ of the output circuit 84 becomes as shown in FIG. 6(*j*).

Therefore, the reignition pulse train as shown in FIG. 4(*b*) which is the composite output of the pulses in positive and negative half cycles is issued and is impressed across the discharge tube 3. The effect of selecting the time period during which the reignition pulses are impressed on the discharge tube to be at least for the duration as defined above is elucidated as follows:

(i) Since the reignition pulse starts to be impressed at least from each zero-cross points, the lamp voltage can be raised to the voltage substantially equal to that of the power source. Impressing of the positive reignition pulses successively for full period of the positive half cycle and impressing of the negative reignition pulses successively for full period of the negative half cycle do not particularly improve the characteristics of the lamp any more. That is, the impressings of the pulses after the phases of peaks p,p' of reignition voltage of lamp voltage waveform do not add any more particular performance on top of the operation to stop the pulses immediately after the peaks p,p'. That is, it is sufficient for an improvement of the extinction problem that the reignition pulse trains last until the phase of peaks of reignition voltage of lamp voltage waveform or immediately thereafter. On the other hand, the lamp impedance largely decreases in an after-peak-period which is from a phase after passing the peak p or p' to a phase which is before a zero-cross point. For example, the lamp impedance decreases to 20–30Ω in the after-peak-period from 50Ω to 500Ω in the reignition period which is from the zero-cross point to the peak point. Useless impressing of the reignition pulses in the after-peak-period of the low lamp impedance, the current in the pulse generator circuit 6 increases due to the low lamp impedance, as well as, the power loss in the switching transistors $Q_6$ and $Q_7$. In the apparatus of the present invention, by selecting the impressing period of the ignition pulses to be from the zero-cross point to the peak point or immediately thereafter, the above-mentioned problem is eliminated. The selection of the phase to stop oscillation of the reignition pulses is freely made by selecting, for example the capacitance of the capacitor $C_3$ and the resistance of the resistor $R_8$.

As a result of the above-mentioned constitution, the lamp apparatus in accordance with the present invention has the advantage that, the lamp voltage can be raised and hence the power loss in the current limiting device, such as a choke coil, can be minimized, and also the bulk and weight of the lamp apparatus can be reduced. Furthermore, by accurately limiting the impressing period of reignition pulses, wasteful power consumption in the pulse generator can be reduced with stable performance of lighting.

What is claimed is:

1. A high pressure discharge lamp apparatus of the type comprising:

a discharge tube and a current limiting device connected in series for connection across an A.C. power source, and a pulse generator connected by its output terminal in parallel to the discharge tube, the apparatus characterized in that:

said pulse generator comprises:

a positive waveform shaper for clipping positive half cycles of the A.C. power source voltage, a negative waveform shaper for clipping negative half cycles of the A.C. power source voltage, a positive reignition pulse oscillator which starts its oscillation at a rise up the output of said positive waveform shaper by receiving output of said positive waveform shaper, and a negative reignition pulse oscillator which starts its oscillation at a rise up in the negative direction of said negative waveform shaper by receiving output of said positive waveform shaper, said pulse generator impressing reignition pulses on said discharge tube at least during a period defined as from a zero-cross point of the source voltage of the power source to a phase defined by a peak of reignition voltage of lamp voltage waveform when no reignition pulse is impressed on the discharge tube, thereby retaining lamp current of the discharge tube without forming zero-current period.

2. A high pressure discharge lamp apparatus in accordance with claim 1, wherein said pulse generator includes means for impressing said reignition pulses on said discharge tube during a period from a zero-cross point of said source voltage to a phase immediately after said peak of reignition voltage of lamp voltage waveform when no reignition pulse is impressed on the discharge tube.

3. A high pressure discharge lamp apparatus of the type comprising:

a discharge tube and a current limiting device connected in series for connection across an A.C. power source, and a pulse generator connected by its output terminal in parallel to the discharge tube, the apparatus characterized in that:

said pulse generator comprises:

a positive reignition pulse controller for outputting a controlling pulse signal after a predetermined time period from said rise up in the negative direction of the output of said positive waveform shaper, a negative reignition pulse controller for outputting a controlling pulse signal after a predetermined time period from said rise up of the output of said negative waveform shaper, a first oscillation stopping means which stops oscillation by said positive reignition pulse oscillator upon receipt of said controlling pulse signal from said positive reignition pulse controller, and a second oscillation stopping means which stops oscillation by said negative reignition pulse oscillator upon receipt of said controlling pulse signal from said negative reignition pulse controller, said pulse generator impressing reignition pulses on said discharge tube at least during a period defined as from a zero-cross point of the source voltage of the power source to a phase defined by a peak of reignition voltage of lamp voltage waveform when no reignition pulse is impressed on the discharge tube, thereby retaining lamp current of the discharge tube without forming zero-current period.

4. A high pressure discharge lamp apparatus in accordance with claim 3, wherein said pulse generator includes means for impressing said reignition pulses on said discharge tube during a period from a zero-cross point of said source voltage to a phase immediately after said peak of reignition voltage of lamp voltage waveform when or reignition pulse is impressed on the discharge tube.

* * * * *